United States Patent [19]

Moulin et al.

[11] Patent Number: 4,553,825

[45] Date of Patent: Nov. 19, 1985

[54] PHOTOCOMPOSING APPARATUS AND METHOD

[75] Inventors: Michel Moulin, Lausanne; Jean-Claude Risse, Prangins, both of Switzerland

[73] Assignee: Autologic, S.A., Bussigny-pres-Lausanne, Switzerland

[21] Appl. No.: 503,228

[22] Filed: Jun. 10, 1983

[51] Int. Cl.[4] ..... B41B 13/00

[52] U.S. Cl. ..... 354/5; 354/212; 355/3 BE; 355/47

[58] Field of Search ..... 354/5, 212; 355/47, 355/3 BE

[56] References Cited

U.S. PATENT DOCUMENTS

| | | | |
|---|---|---|---|
| 2,790,362 | 4/1957 | Higonnet et al. . | |
| 3,016,209 | 1/1962 | Higonnet et al. . | |
| 4,014,031 | 3/1977 | Hasegawa et al. | 354/5 |
| 4,087,177 | 5/1978 | Gumm et al. | 355/47 |
| 4,170,175 | 10/1979 | Conlon, Jr. | 355/3 BE |
| 4,329,027 | 5/1982 | Moyroud et al. . | |

*Primary Examiner*—Russell E. Adams
*Attorney, Agent, or Firm*—Gregor N. Neff

[57] ABSTRACT

Photosensitive sheet handling apparatus and method for phototypesetters. Accurate control of the lateral positioning of the sheet (i.e., film) is provided by the use of tapered drive rolls. The apparatus includes an input cassette, a film input drive assembly comprised of tapered pinch rollers and a lateral film edge locating stop, a slightly tapered vacuum film drive drum having a collar or flange on one side in accurate alignment with the edge locating stop of the pinch rollers, a motor operated output drive assembly also comprised of tapered pinch rollers and a film edge locating stop in accurate alignment with the drum flange, and a periodically operated film winding mechanism located within an output cassette. The tapered rolls urge one edge of the film against the flange of the drum and stops of the pinch rollers to maintain accurate alignment. Chambers are provided for receiving loops of film at the input and output sides of the drum. The film moves forwardly for leading, and moves in the reverse direction for reverse leading. During the reverse motion, film is withdrawn from one of the loops while another loop is formed to take up the film. This avoids the scratching and wear which otherwise would occur by repeatedly passing the film through the pinch rollers. The film winding mechanism in the output cassette winds the film under tension, but periodically relieves the tension in order to prevent the film from jamming in the output cassette.

27 Claims, 21 Drawing Figures

PHOTOCOMPOSING APPARATUS AND METHOD

BACKGROUND OF THE INVENTION

1. Field of the Invention

The invention relates generally to apparatus and methods for handling photosensitive sheet materials such as photographic film in photocomposition; more particularly, the invention relates to apparatus and methods for accurately controlling the lateral position of the photosensitive material before, during and after its passage through the exposure zone at which character images are formed. The invention further relates to a film take-up mechanism and method to facilitate loading relatively large amounts of exposed film into removable cassettes.

2. Prior Art

In the present state of the art, photographic film or paper handling systems for phototypesetters generally include a driving mechanism comprised of pinch rollers to pull the film out of a supply roll through a flat "exposure window" where the film, during the formation of character images, is held in the focal plane with adequate accuracy. A typical prior system such as that shown in U.S. Pat. No. 3,016,209 uses a fixed locating pad on which the film is held by a spring loaded pressure plate.

Some of the problems encountered in prior art devices are the following:

Difficulty of moving the film forwardly and backwardly repetitively for forward and reverse leading (line spacing), for example, in the composition of columns, tables and the like, along an accurate and repetitive path and without excessive scratching or wear on the film.

Difficulty of laterally guiding the film during machine operation to avoid a wavering left hand margin. If the mechanism is provided with edge guides, the film has a tendency either to wander away from the guides, or to climb over the guides and create a film jam because the lateral force required to move the film laterally away from the guide is too great because of the friction of the pinch roller which is necessary for accurate leading (line spacing).

Difficulty of loading relatively large amounts of exposed film into the output cassette. This is believed to be caused by tension created by the winding mechanism which prevents the newly-wound film from freely taking its natural position around the winding core within the cassette. The result is "film jams" or "bunching" of the film.

OBJECTS OF THE INVENTION

The main object of the invention is to provide photocomposing apparatus and methods in which the foregoing problems are avoided or greatly alleviated. Other objects will become apparent from the text and claims which follow.

SUMMARY OF THE INVENTION

In accordance with the present invention, the foregoing objects are satisfied by the provision of a photocomposition apparatus and method in which at least one tapered roll is used to feed a web of photosensitive material to and from an exposure station at which character images are formed. An abutment is located near the roll. The taper of the roll gently but firmly urges the edge of the material against the abutment to maintain the lateral position of the material accurately. Preferably the tapered roll can be a vacuum drum which holds the material against it by the force of a vacuum, with the abutment being formed by a flange, and/or tapered pinch rollers with a stop member to serve as the abutment.

The objects are further satisfied by the deliberate formation of at least one loose loop of the photosensitive material from which material can be withdrawn for reverse motion, and to which photosensitive material can be added, during forward motion, so as to avoid repeatedly using pinch rollers on the material. This avoids or minimizes scratching and wear on the photosensitive material.

Another feature of the invention resides in the operation of the film output means to periodically release the longitudinal tension created in the material by the drive means associated with the output cassette. This enables the storage of substantial quantities of material in the output cassette without jamming.

Other objects and features of the invention will be described in or apparent from the following detailed description and drawings.

DRAWINGS

GENERAL DESCRIPTION

Figure 1:
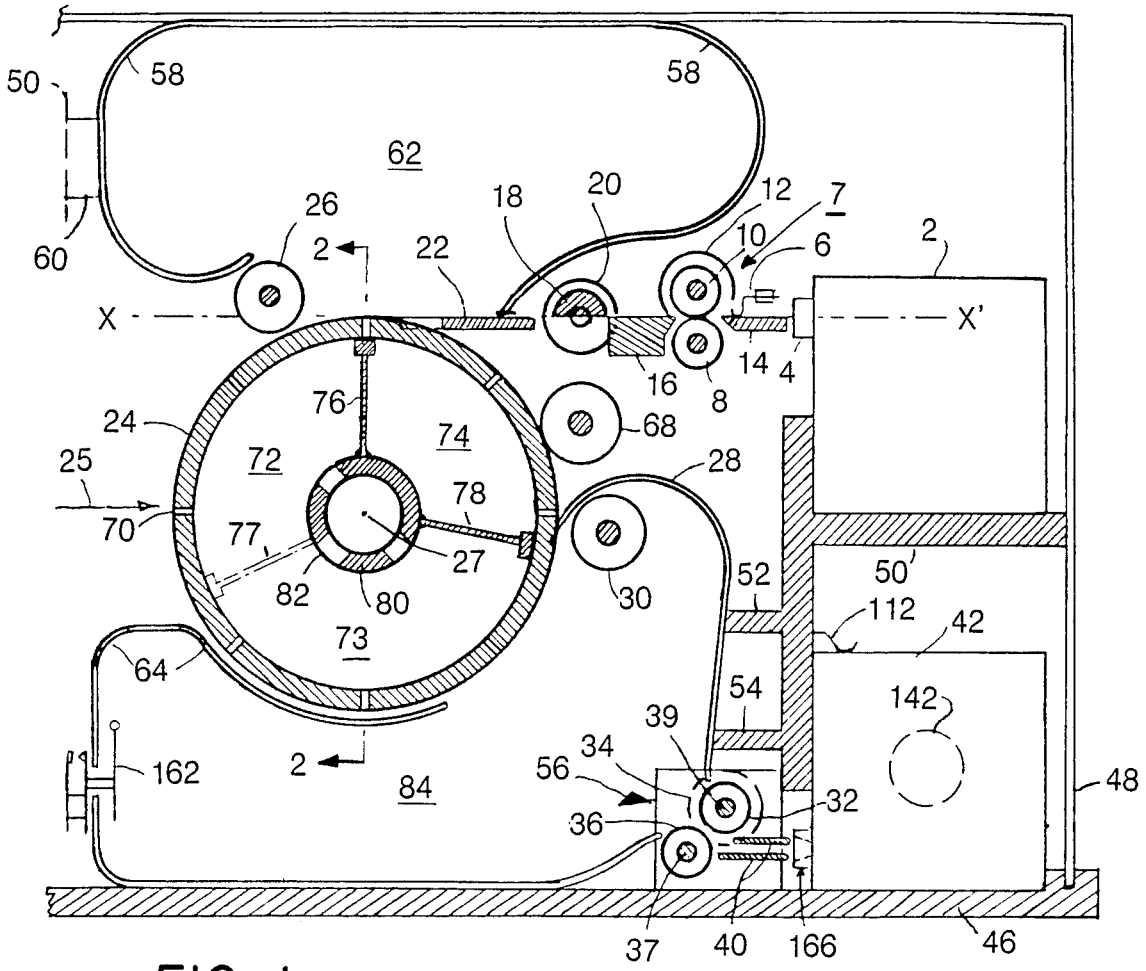
FIG. 1 is a partially schematic cross-sectional view of a photocomposing device utilizing the invention.

The photocomposing device shown in FIG. 1 is only part of a complete photocomposing machine. The complete machine preferably is of the type shown in U.S. Pat. Nos. 4,329,027 and 4,329,026, the disclosures of which hereby are incorporated by reference. Only the structure for handling the photosensitive material (film) is shown.

Figure 2:
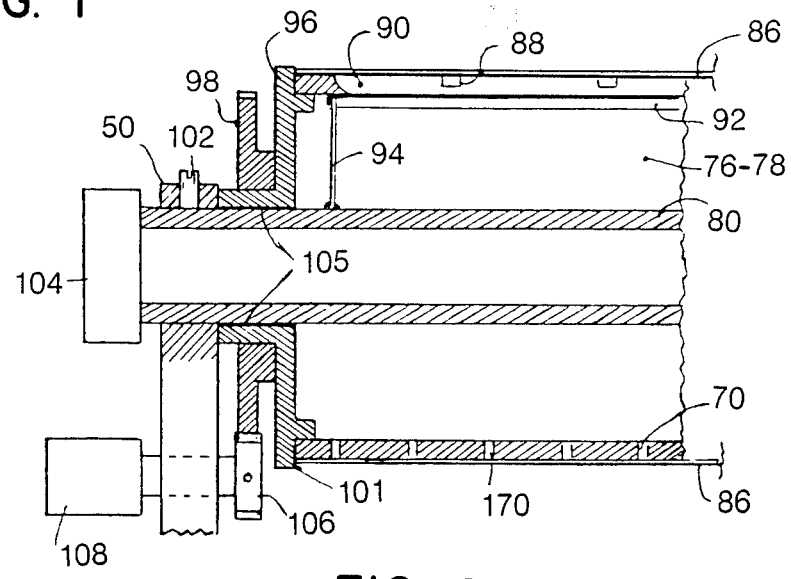
FIG. 2 is a broken-away cross-sectional view, taken along line 2–2 of a portion of the device of FIG. 1.

In the complete photocomposing machine, character presentation means and character spacing means are provided to form and project character images in the direction of the arrow 25 toward a drum 24 around which is wrapped photographic film 86 (FIG. 2). Lines of characters are formed on the film in a direction parallel to the axis of rotation 27 of the drum 24. The drum is rotated counterclockwise to produce forward leading (line spacing), or clockwise to produce reverse leading.

The mechanism in FIG. 1 is mounted on a base plate 46, and is enclosed in a light-tight housing 48.

It should be understood that the invention is useful with several different types of photosensitive sheet materials, including photographic film or paper, flexible electrophotographic plate material, etc. For the sake of convenience, the use of the invention with photographic film will be described, with the understanding that the description applies to other photosensitive sheet materials as well.

DETAILED DESCRIPTION

Referring to FIG. 1, an input film cassette 2 provided with a light seal 4 is removably secured to the frame 50 of the phototypesetter. To support the film emerging from the cassette there is provided a plate 14 associated with a switch schematically shown at 6 for purposes to be explained later.

An input pinch rollers assembly 7 is provided. That assembly includes a drive roller 10, a drive motor 12 and an idler roller 8. At the output of the input rollers assembly, the film is supported by a block 16 having an edge co-operating with a rotary cutter 18 driven by a motor or solenoid 20. The film is further supported by a plate 22. The upper surfaces of plates or guides 14, 16 and 22 are aligned in a plane, represented by line X—X', which is tangent to the drum 24.

The drum 24 is used for the double purpose of driving the film past the exposure zone or station and maintaining the film at that location in the focal plane of the machine. The drum 24 is similar to drum 34 shown in FIGS. 1, 57 and 58 of U.S. Pat. No. 4,329,027, except that it is slightly frustro-conical, as will be explained later.

The drum 24 is attached to end plates 96 shown in FIG. 2 in a structure which is similar to FIG. 58 of U.S. Pat. No. 4,329,027. In FIG. 2, a vacuum control gate is shown at 104 and a hollow fixed central tube at 80. The purpose of tube 80 is to transfer the negative air pressure from a vacuum source through the gate 104 to selected inside areas of the drum, as explained in U.S. Pat. No. 4,329,027. The drum assembly can be caused to rotate around tube 80 on bearing surfaces 105.

The drum assembly is driven by a motor unit 108 through a pinion 106 and a gear 98, as shown. The complete assembly is attached to the frame 50 of the machine by set screws such as 102.

To make the drum air-permeable, holes 70 associated with grooves as shown in U.S. Pat. No. 4,329,027 can be used, or, as shown in the upper section of FIG. 2, the connection between the outer surface of the drum and its inside area can be obtained by a number of longitudinal narrow slots 90 connected together by circumferential circular grooves 88.

In FIG. 2, the film is schematically represented at 86. The exact lateral position of the film is insured by the outer edge of the plate 96 which forms a flange 101 against which the edge of the film 86 abuts.

In FIG. 2, parts 94 and 92 are parts of the inside partitions 76–78 which divide into two or more chambers such as chambers 72 and 74 of FIG. 1. With the drum 24 in the position shown in FIG. 1, chamber 72 is connected to the vacuum source (not shown) so that it will cause the film located around its periphery to be "stuck" or held against the drum surface.

The amount of the vacuum can be varied according to the amount of negative pressure desired, which depends on losses caused by the chamber not covered by the film in the initial "wraparound" operation, and also on the thickness or the rigidity of the film in use. The control of the vacuum chambers can be accomplished as explained in U.S. Pat. No. 4,329,027. The partition 77 is shown in dashed lines to indicate that it is optional and can be added to create more chambers.

In the example shown in FIG. 1, the chamber at 74 is never connected to the vacuum pump for normal roll-film operation. The chamber at 72 is connected to the vacuum source throughout the operation of the machine, and the chamber at 73 is not connected during the initial "wraparound" operation in order to concentrate the vacuum produced in the chamber at 72 and thus facilitate that operation, particularly when rather stiff photosensitive material is used.

In the upper section of FIG. 1, there is a chamber 62 formed by a housing 58 attached by a mounting member 60 to the frame 50 of the device. In the lower portion of FIG. 1 there is another chamber 84 formed by a housing 64 and a preformed guide plate or fingers assembly 28 attached to extensions 52 and 54 of the frame 50.

The drum drive motor and shaft position encoder are shown schematically at 68. The output of the encoder is coupled to a suitable electronic circuit 178 (FIG. 21) to represent, in digital form, the distance moved by the drum, and the distance of film movement, the direction of film motion, the angular position of the drum and the speed of its rotation at any instant of time. The details of the circuit 178 and the encoder to perform these functions are well known. Roller 26 is located above the drum but not in contact with it. Its purpose is to guide the film during the loading operation. Roller 30 is located near the drum and the inner surface of guide 28 for film guiding purposes.

An output pinch roller assembly 56 is provided. It comprises a drive roller 32, its drive motor 34, an idler roller 36 and guide plates 40. An output film cassette 42 is provided. It has an input aperture 66 which may include a light seal. The cassette 42 is secured to the frame 50 of the machine by spring loaded latches, shown schematically at 112, to facilitate the insertion and removal of the cassette.

Figure 3:
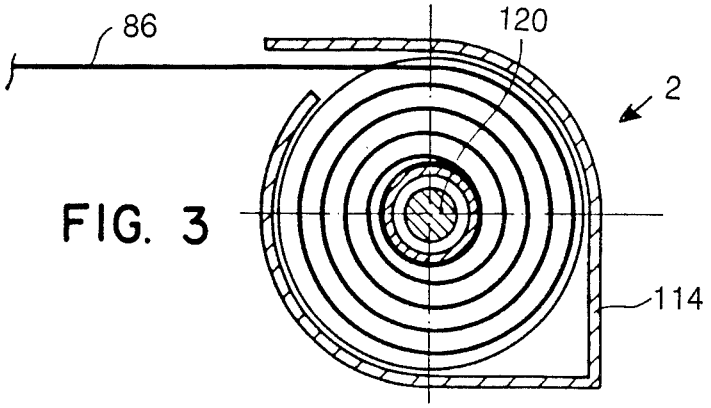
FIG. 3 is a partially schematic cross-sectional view of the input cassette of the FIG. 1 device.
Figure 4:
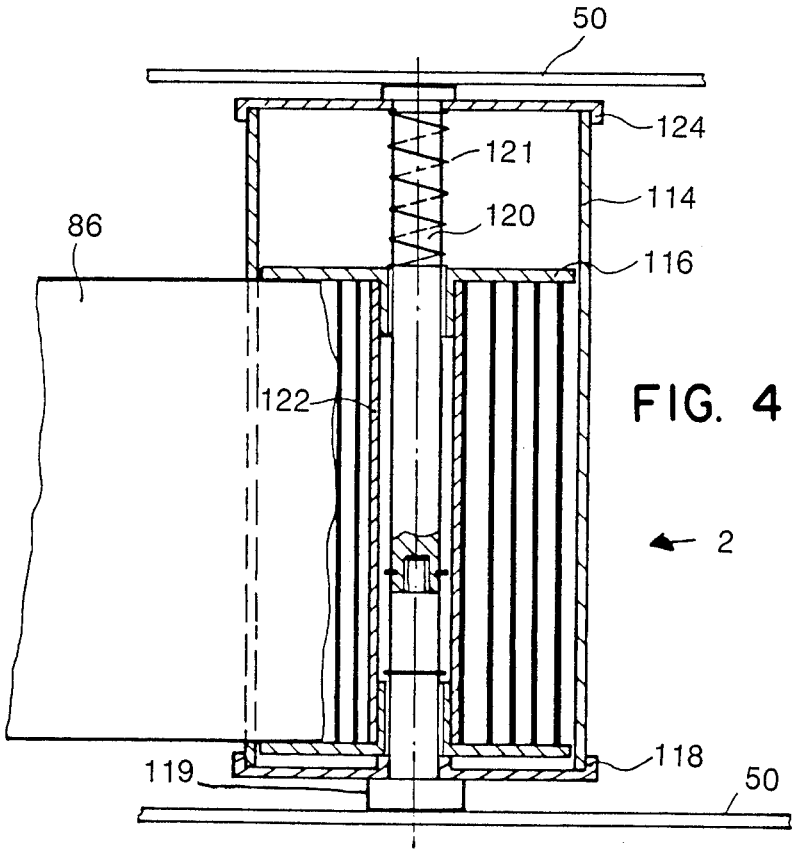
FIG. 4 is a partially schematic longitudinal cross-sectional view of the input cassette of FIG. 3.

The input cassette 2 is shown in detail in FIGS. 3 and 4. The cassette is made up of a housing 114 and end plates 118 and 124 (FIG. 4). The cassette 2 is removably attached to frame members 50 of the machine to hold it securely in place.

The cassette 2 can accommodate film rolls of various widths, selected according to the work to be done. The film is wound on a spool 116 which is pushed against the lower cassette end plate 118 (FIG. 4) by a spring 121. The spool is rotatably mounted on a center shaft 120. The film is wound around a central tubular core 122. A "leader" such as shown at 86 protrudes out of the cassette when it is installed in the machine for initial film feeding, as will be explained later.

Figure 5:
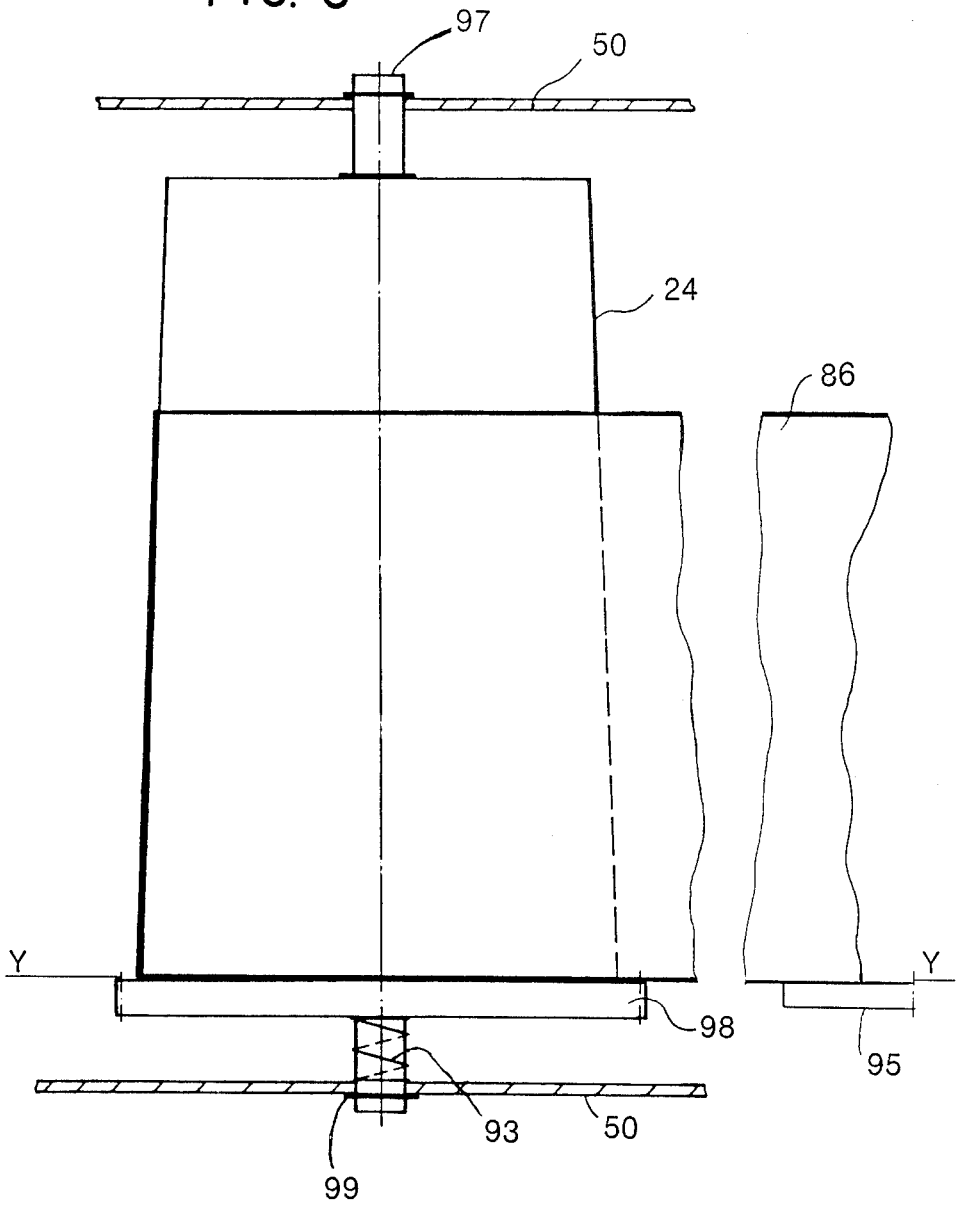
FIG. 5 is a schematic representation of the film drum of the device shown in FIG. 1.

The film drum 24 is shown schematically in FIG. 5. In FIG. 5, the frustro-conical shape of the drum is visible. The amount or degree of conicity or taper is exaggerated for better understanding of the invention. In an actual embodiment of the invention, the degree of conicity or taper of the drum is no more than 0.01 percent (one tenth per thousand); that is, the radius of the drum decreases by no more than one unit of measurement for every ten thousand units of length of the drum. This value has been determined experimentally and it has been found quite acceptable for a drum whose diameter is large relative to that of the pinch rollers. The accurate positioning of the drum in the machine is obtained by a spring 93 whose purpose is to urge the drum assembly against one of the frame members 50 of the machine, for example, by use of an E-ring 99. The flange 98 is located near the end of the drum which has the largest diameter. The lateral position of the edge of the film 86 along line Y—Y' tangent to flange 98 and a guide 95 is accurately obtained and maintained by the action of the slight taper of the drum, assisted in the normal forward feeding by the tapered input roller shown in FIG. 6.

Figure 7:
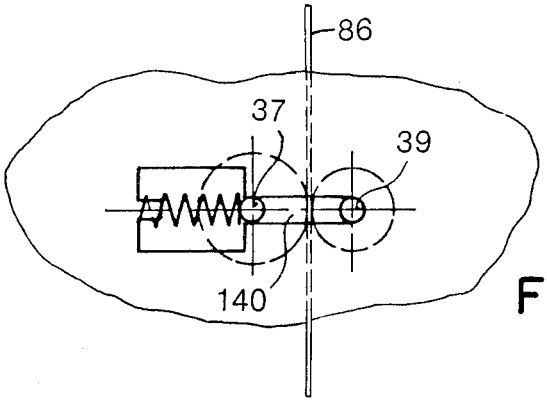
FIG. 7 is an end elevation view of the pinch rollers of FIG. 6.
Figure 6:
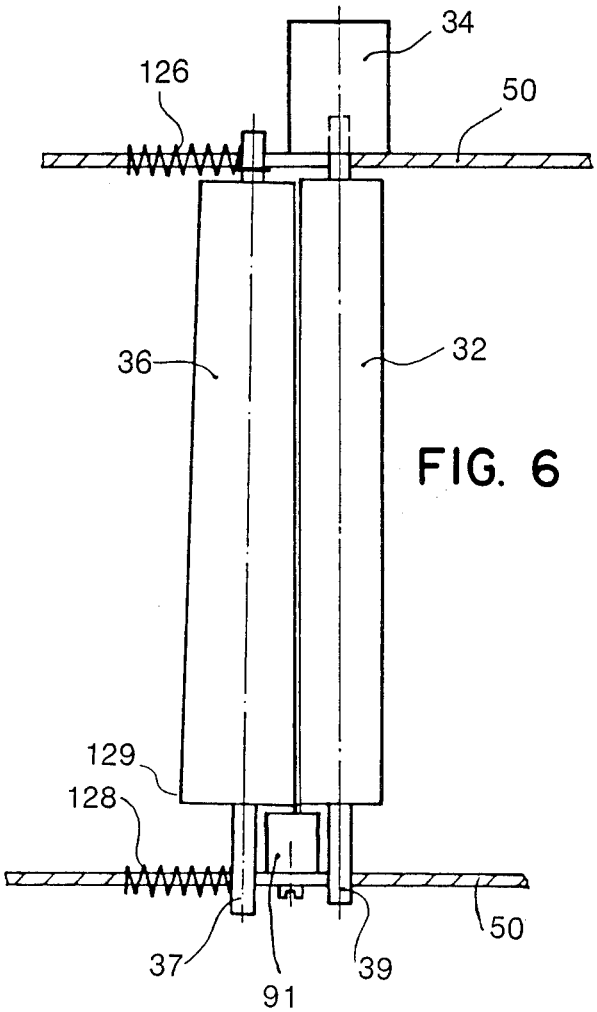
FIG. 6 is a plan view of a pair of pinch rollers of the FIG. 1 device.

Referring now to FIGS. 6 and 7, a cylindrical roller 32, driven by a motor 34 coupled to the shaft 39 of roller 32, is rotatably attached to frame members 50 as shown. The film 86 (FIG. 7) is pressed against the cylindrical roller 32 by frustro-conical roller 36 due to the combined action of springs 126 and 128. The shaft 37 of the frustro-conical or tapered roller is free to move in a slot 140 (FIG. 7).

The conicity of roller 36 is greater than the conicity of the film drum. In the actual machine, it has been found that good results are obtained by a degree of conicity or taper of approximately 0.1 percent. This taper is sufficient to hold the edge of the film against a lateral film stop or guide at 91, which is mounted near the end 129. of the tapered roller 36 which has the largest diameter.

The above description made in connection with FIGS. 6 and 7 also describes the output rollers assembly 56. The film guide member 91 of each of the input and output rollers assemblies is aligned with the flange 98 on the drum 24.

Figure 9:
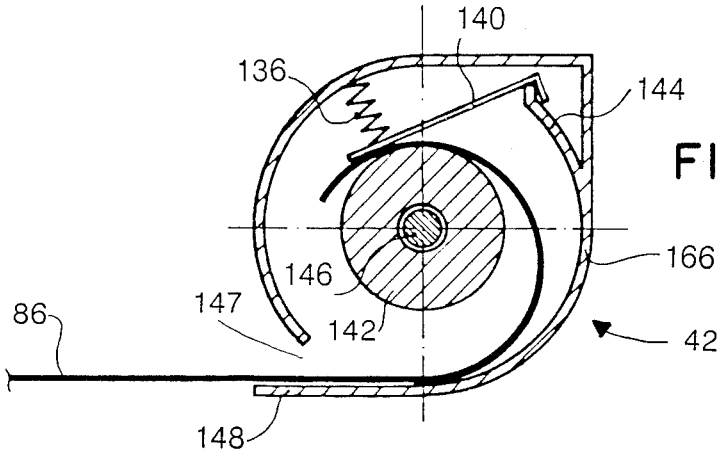
FIG. 9 is a partially schematic transverse cross-sectional view of the output cassette of FIG. 8.
Figure 8:
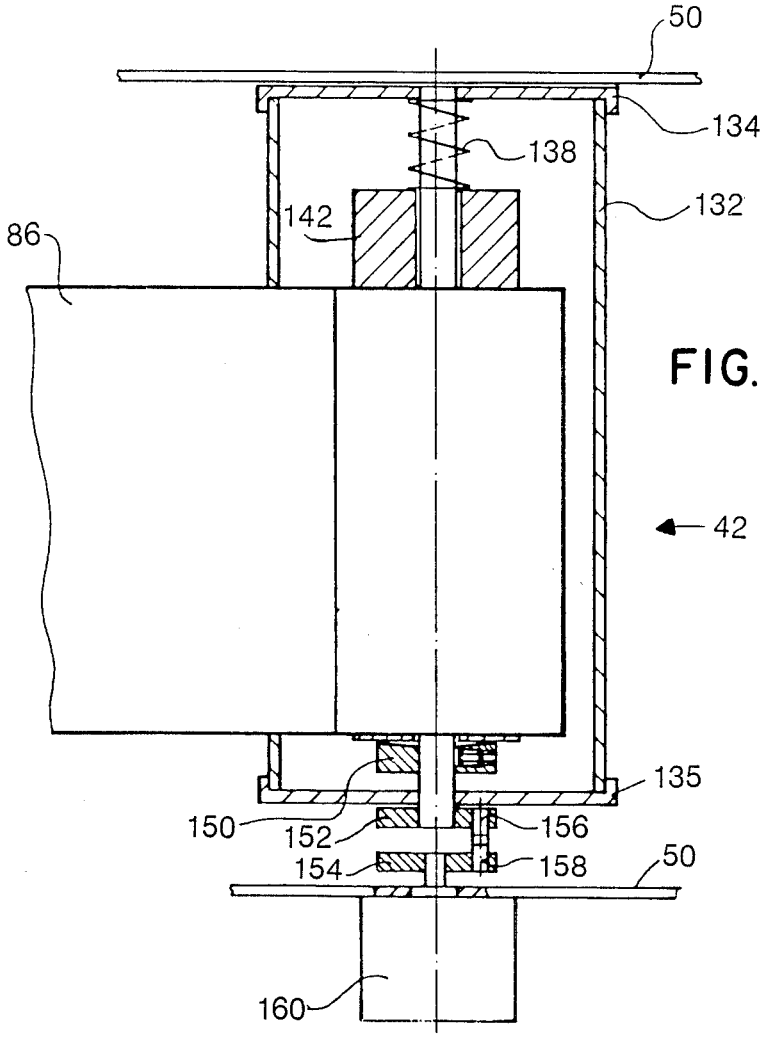
FIG. 8 is a partially schematic longitudinal cross sectional view of the output cassette of the FIG. 1

The output cassette assembly 42 is shown in detail in FIGS. 8 and 9. It is comprised of a housing 166 having a supporting lip 148 below the film entrance 147 and an inner extension 144 which supports a blade 140 urged downwardly by a compression spring 136 to help in winding the film 86 around the core 142. The end covers of the cassette are shown at 134 and 135. A compression spring 138 located between cover 134 and core 142 pushes the latter against a friction drive member 150. One end of core shaft 146 is attached to a driven ring 152 coupled through pins 156 and 158 attached to a drive ring 154 which is driven by a motor 160. The core 142 is preferably free to slide and rotate on the core shaft 146, and preferably is driven through a friction drive coupling to avoid excess tension in the film.

Figure 10:
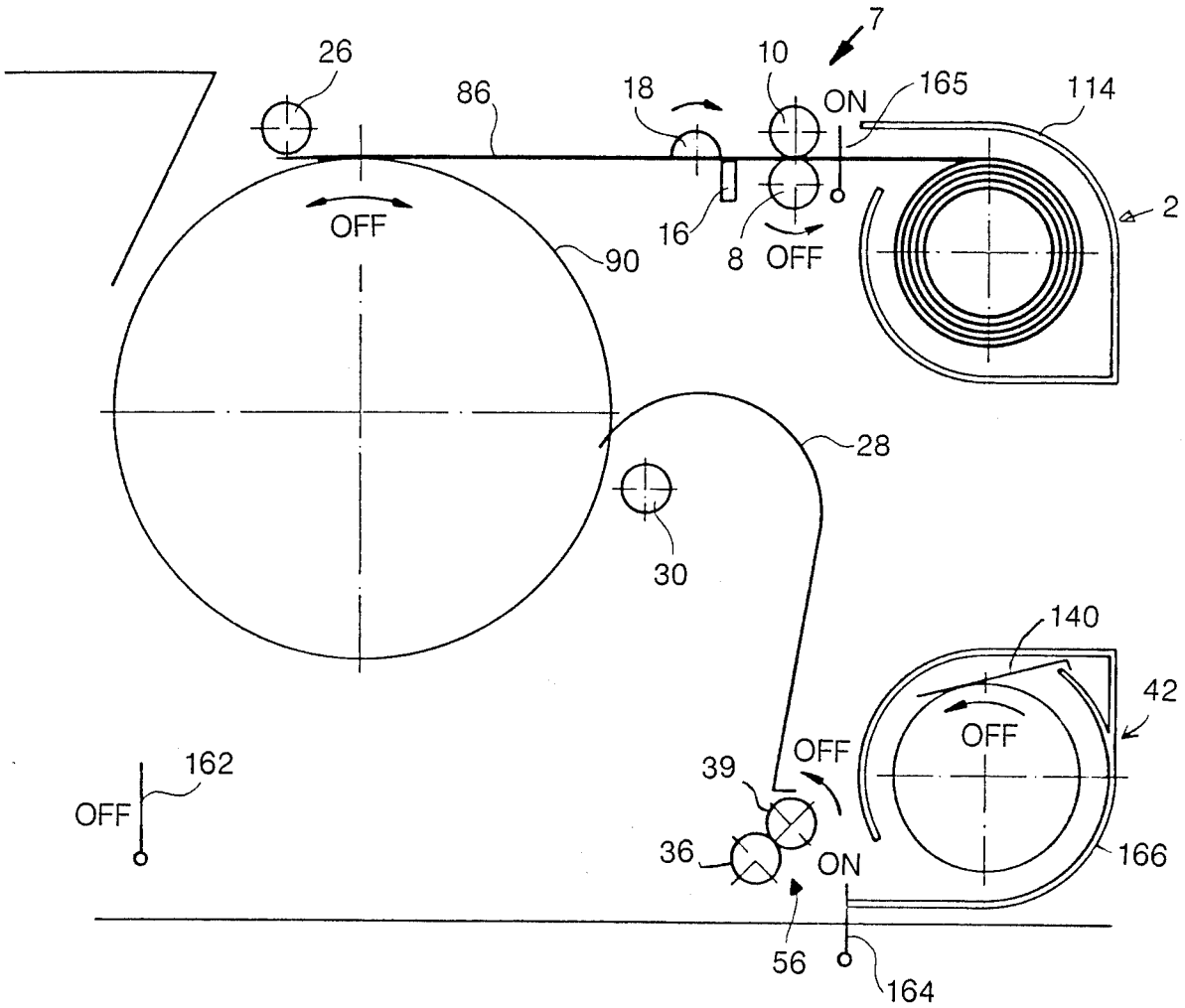
FIGS. 10 to 20 are schematic diagrams showing the location of the various components of the device of FIG. 1 during a complete cycle of its operation.

The sequence of operations from manual film loading to the end of a "take" will be described in relation to FIGS. 10 to 20, where the mechanical components are shown at the same locations as in FIG. 1, and the film is shown at different locations. In FIG. 10, 165 represents schematically the "no film" switch, which has the same purpose as spring contact 6 of FIG. 1. A limit switch 162 is mount in the chamber 84, for purposes to be explained. A "no cassette" switch 164 is provided to indicate that there is no output cassette in the machine.

First sequence—initialization (FIG. 10).

Turn "on" the machine (vacuum on).

Lift covers 48 (FIG. 1).

Pull film leader from supply spool by hand.

Introduce film through input rollers assembly 7, under The rotary cutter 18 until it reaches a point slightly beyond roller 26 where the evacuated section of the drum will be effective.

Close covers.

Figure 11:
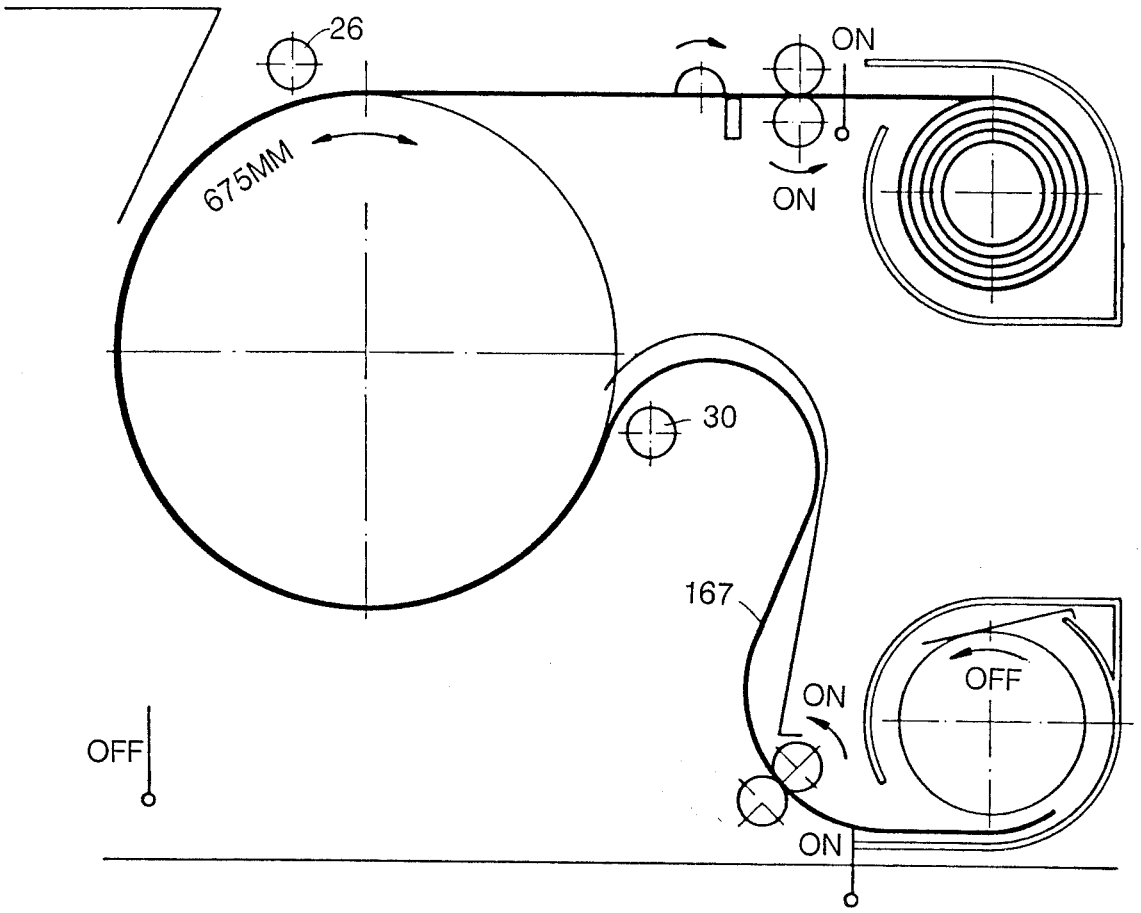

Second sequence (FIG. 11).

on the input rollers motor 12 (FIG. 1), the drum motor 68 (FIG. 1), and the output rollers motor 34. The film starts its automatic feed inside the apparatus and the shaft position encoder for the drum 24 gives to the control circuit the necessary information on the film motion to form a film loop 167 as shown in FIG. 11. The total amount of film thus entered into the machine can be, for example, 675 mm and the operation can be performed at a speed of 52 millimeters per second. During the last 100 mm of the film feeding operation, the input rollers motor preferably is turned off to absorb any slack which may have developed.

Figure 12:
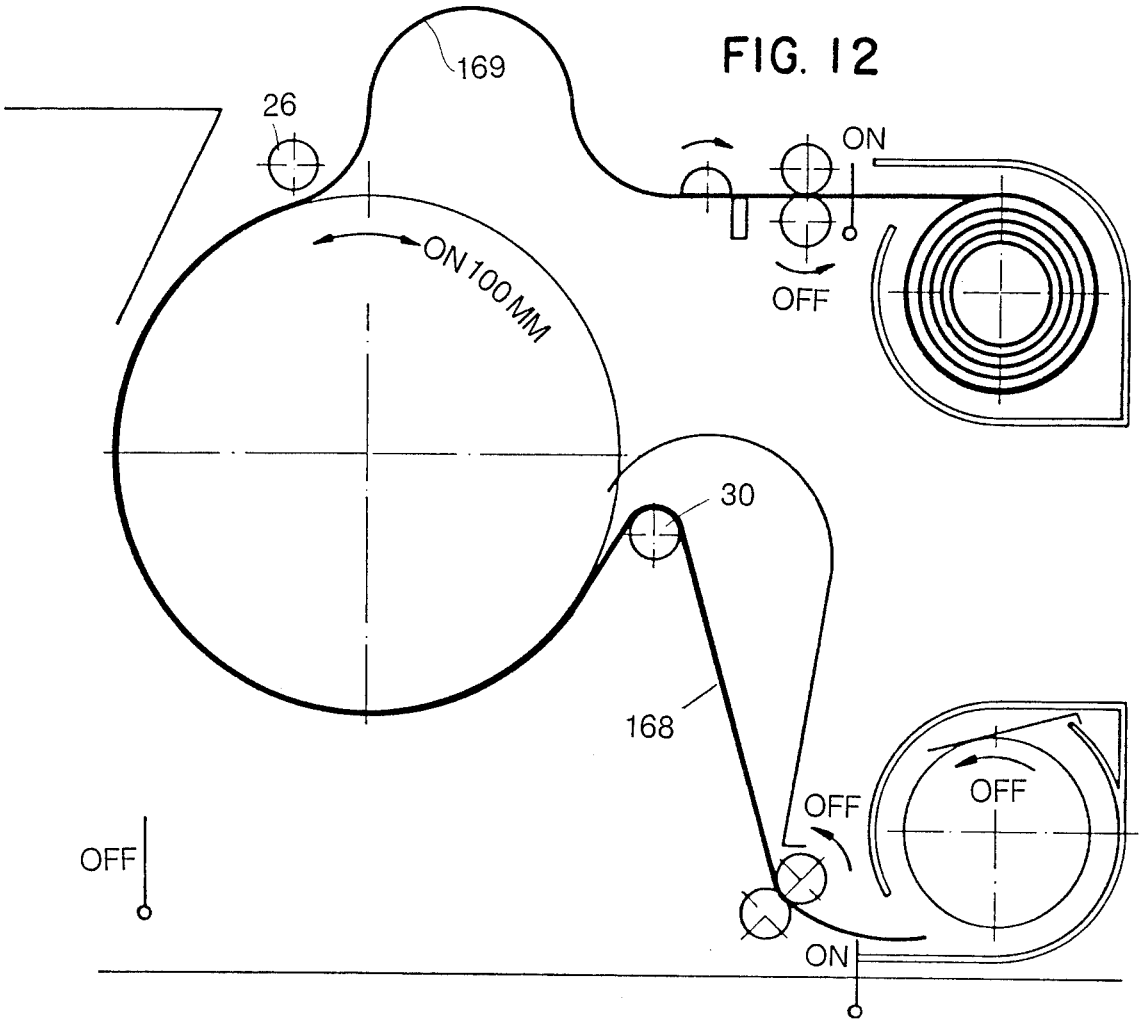

Third sequence (FIG. 12).

Input and output rollers motors are turned off. Move the film in the reverse direction, by means of the drum 24, by approximately 100 mm to force the film against the roller 30. The film now is taut at position 168, and a small loop 169 is formed between the drum and input rollers. The purpose of this sequence is to "straighten out" the portion 168 of the film between roller 30 and the output rollers.

Figure 13:
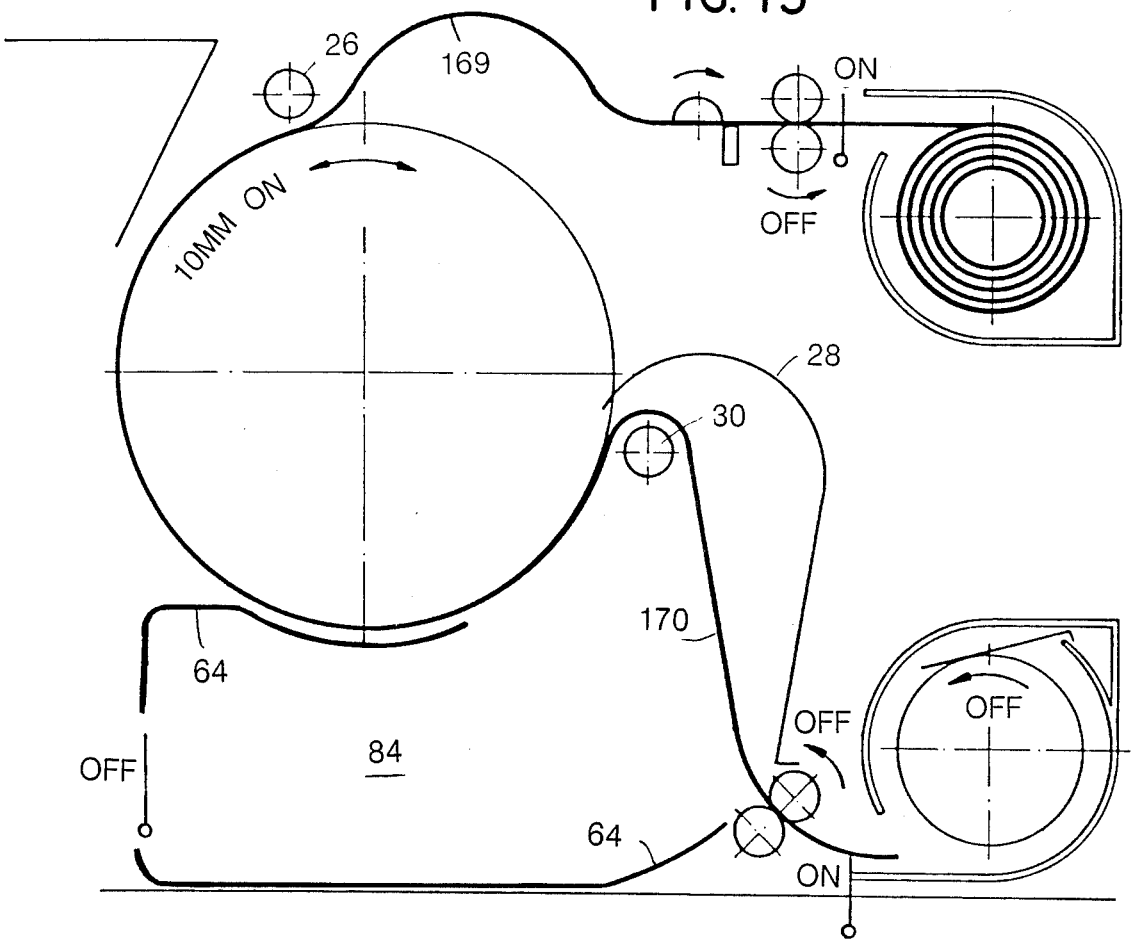

Fourth sequence (FIG. 13).

Move film foward (normal leading direction) by approximately 10 mm, with input and output rollers idle, in order to release the tension temporarily created by the previous sequence. As shown, at the end of the sequence, the film has lost contact with roller 30.

Figure 14:
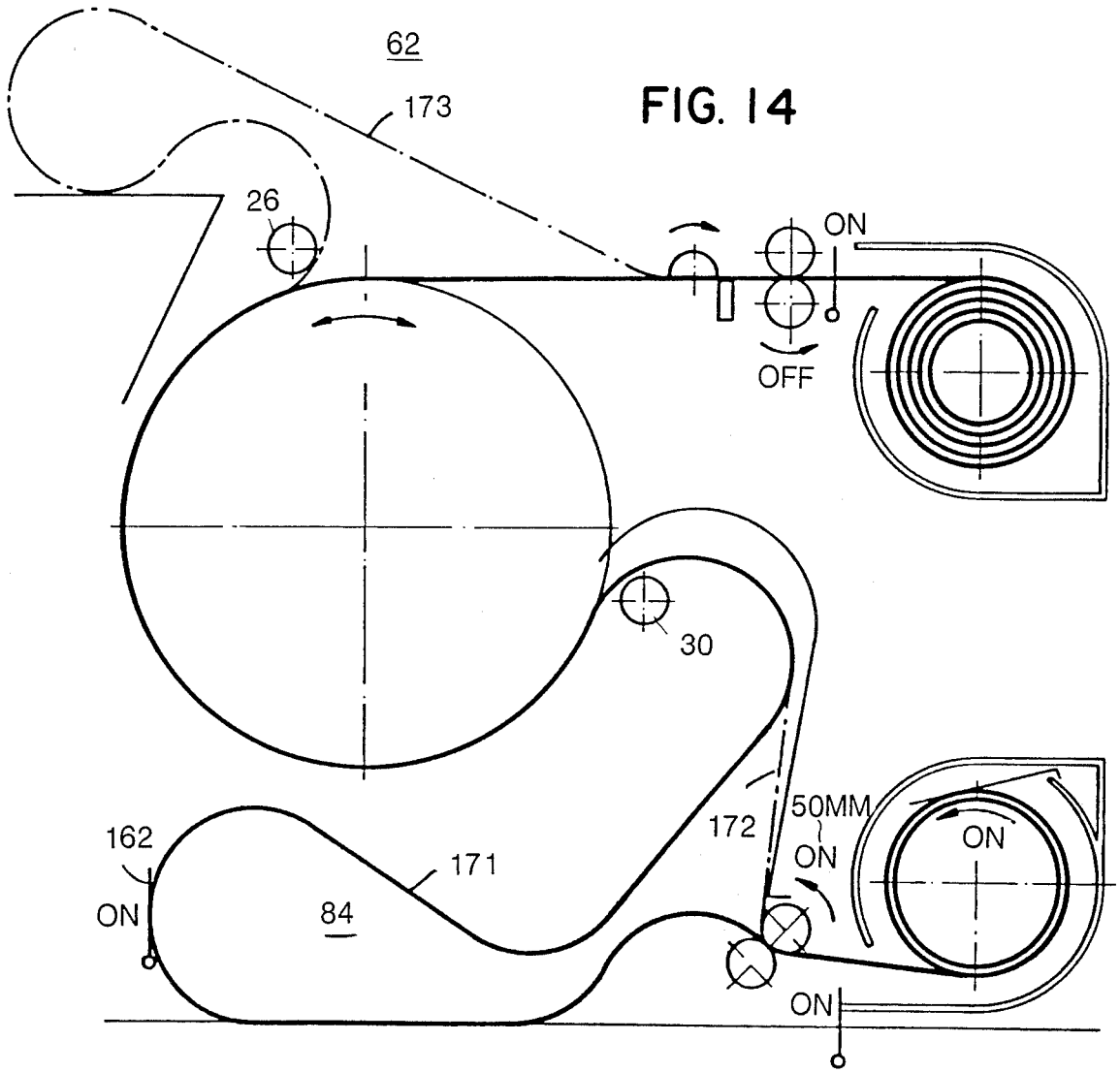

Type composition (FIG. 14).

Normal type composition now starts. The drum 24 rotates counterclockwise as it does forward leading to space lines of characters from one another on the film. The drive motors for the pinch rollers and output cassette are turned off. Thus, as the film is fed fowardly, the film in the section 170 (FIG. 13) between the roller 30 and the output pinch rollers sags downwardly and forms a loop which falls into the chamber 84.

FIG. 14 shows the loop 171 which is formed after the film has been moved forwardly for a substantial length of time. Preferably, the length of film allowed to accumulate in the loop 171 is more than sufficient to accommodate the maximum amount of reverse leading which can be expected. Normally, this will be more than one full page of text matter. The chamber 84 (and the upper chamber 62) are dimensioned so that they will accommodate the full amount of film without creasing or otherwise permanently deforming it.

The purpose of the automatically programmed formation of the lower film loop 171 is to facilitate the reverse leading operation, when it is called for. For example, FIG. 14 shows in dotted lines the position of the film loops after reverse leading of approximately 300 millimeters of film. As shown, the lower loop has moved from position 171 to 172 and the upper loop 173 has been formed in the chamber 62. The loop 173 will be absorbed during the composition, for example, of a second column adjacent to the previously composed first column on the film.

This forward-and-backward sequence can be repeated several times during the composition of a page, as several separate columns are composed in sequence, for example. In prior systems, this would mean that the pinch rollers would pass over the film several times during the composition of the page. This often scratches and damages the film and reduces the quality of the composition job. However, with the use of the present invention, the pinch rollers remain idle as the drum 24 removes and replaces loose film from the loops 171 and 173. This prevents damage by repeated contact with the pinch rollers.

During successive forward and reverse movements of the film already inside the film cavities 62 and 84 (FIG. 1) that is, even when no film is pulled out of the input cassette and no film is fed into the output cassette, the exact edge location of the film is not lost thanks to the slight taper of the drum which continuously tends to maintain the film edge against flange 101 (FIG. 1) shown at 98 in FIG. 5 along line Y—Y'. The taper of the drum has been chosen to insure constant contact with the flange or shoulder without applying excessive edge force to the film. It has been found, for example, that the film can be moved forwardly and backwardly at least thirty times without any loss of positional accuracy either longitudinal or lateral.

Figure 15:
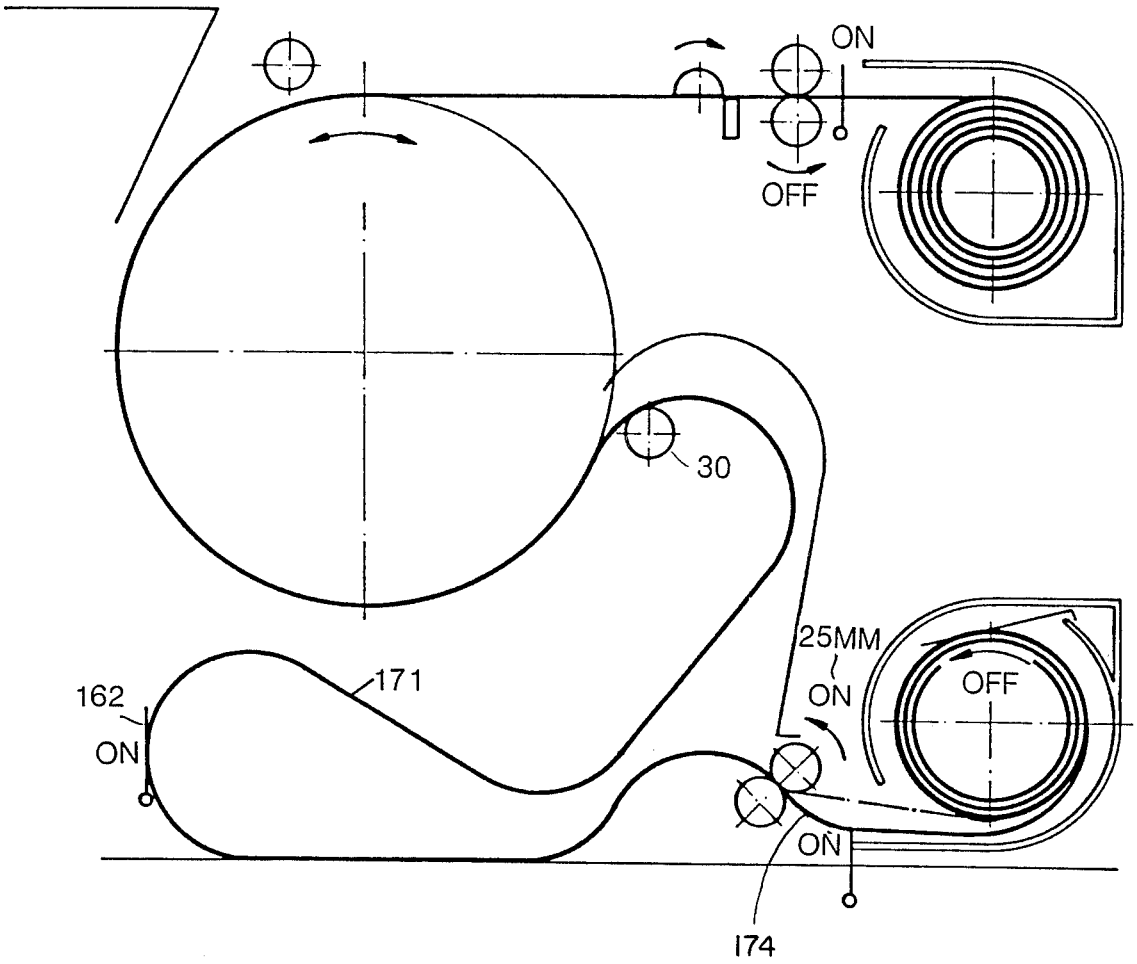
Figure 16:
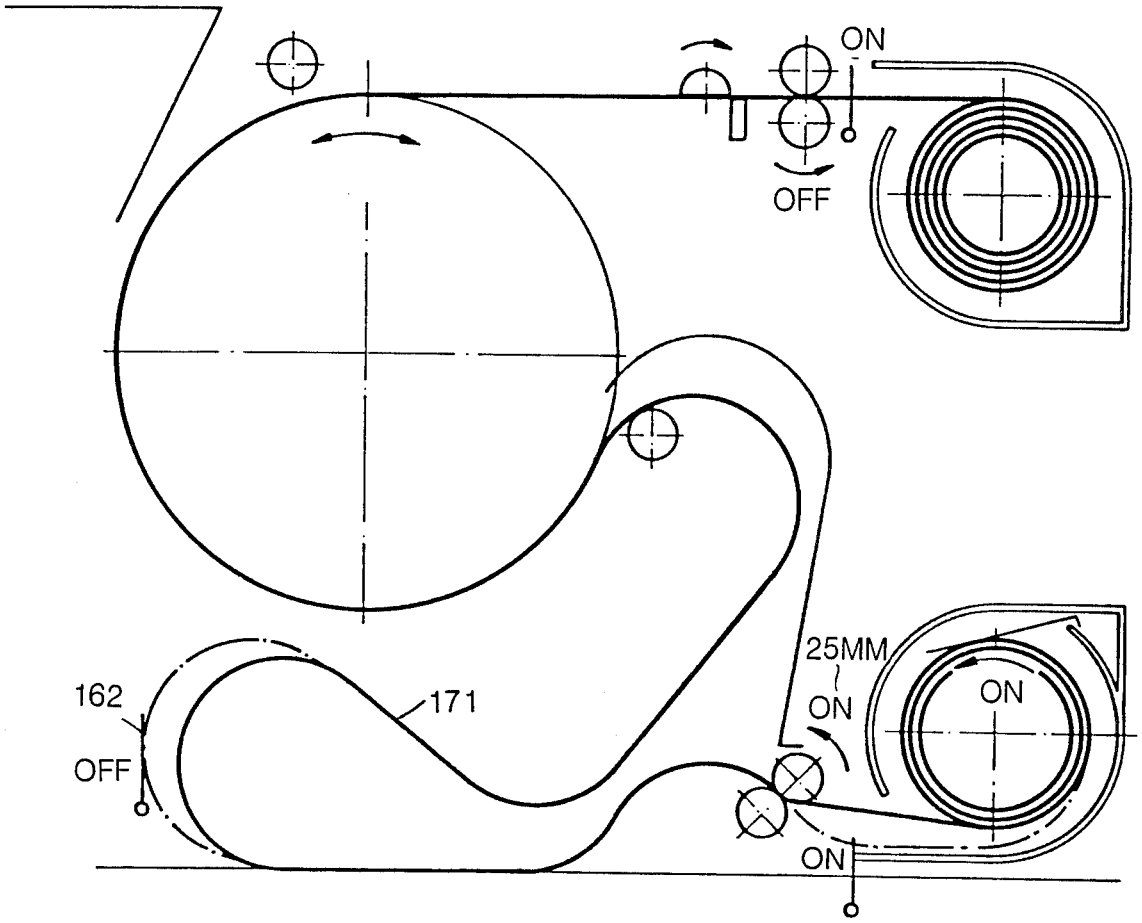

Following sequences (FIGS. 14, 15 and 16).

When the film loop 171 gets so large that it closes the limit switch 162, the output rollers motor and the cassette motor are both turned on, and the winding of the film on the output core of the cassette starts.

The output cassette motor pulls the film at a faster rate than the output rollers permit the film to move, so that tension is applied to the film and a rather tight winding occurs. After the core has made the first two revolutions inside the cassette, which takes approximately two seconds with the cassette motor rotating at one turn per second, the cassette motor is stopped in order to release the stress inside the output cassette and let the film assume a "free" position in order to avoid film "bunching." As the output rollers motor 34 is still energized, the film has a tendency to assume the slack position shown at 174 in FIG. 15. In the example shown, the cassette motor is energized again to take up film slack for one second and the output rollers motor for half a second. This operation is repeated several times until the lower film loop 171 has shrunk and allowed the limit switch 162 to open, as shown in FIG. 16. Then, when the loop 171 again gets large enough to close the switch 162, the output sequence is repeated.

Figure 17:
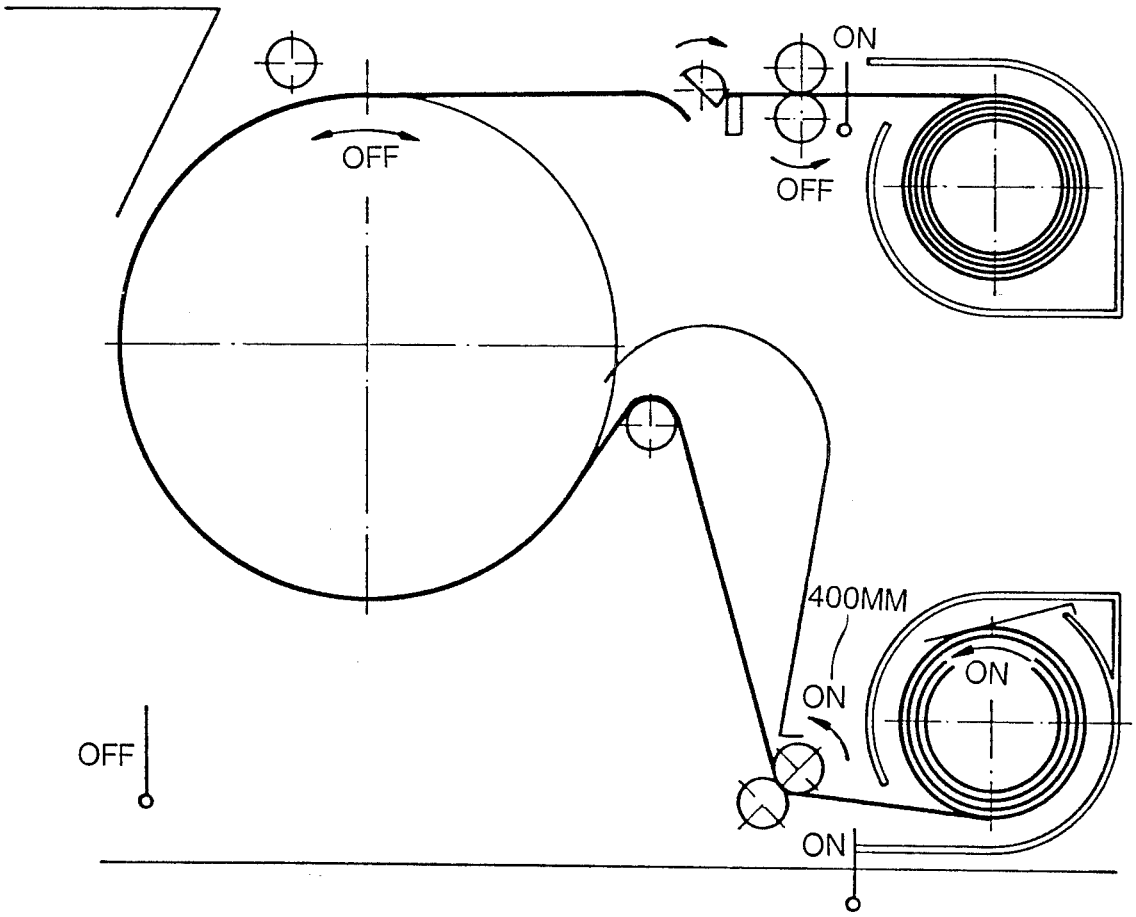
Figure 18:
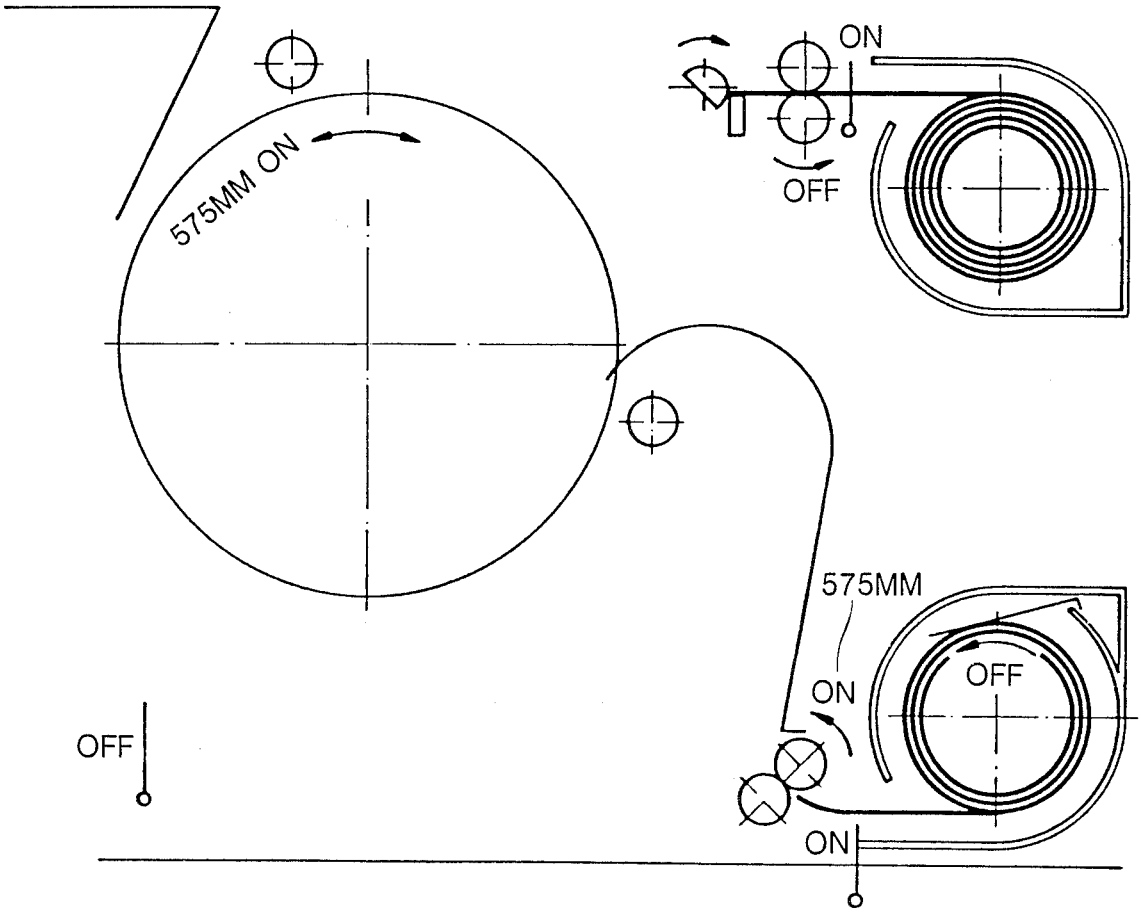
Figure 19:
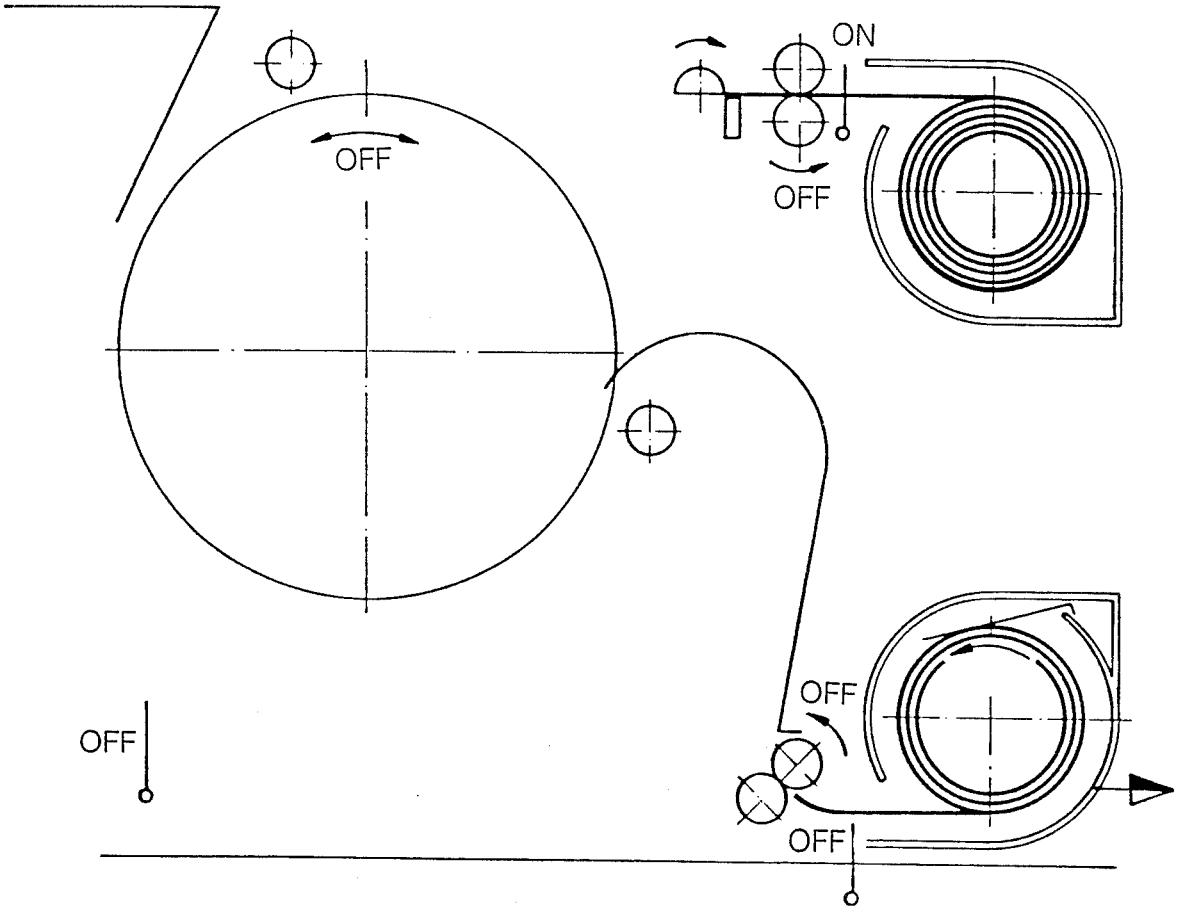

"End of take" sequence (FIGS. 17, 18 and 19).

When an "end of take" code is detected by the control circuit of the machine, it triggers the following sequence of operations:

Rotate film drum forward to absorb the upper film loop, if there is any, as determined by the drum shaft position encoder which, at all times, informs the general control circuit of the film motion.

Cut film by energizing cutter motor 20 (FIG. 1).

Energize the output rollers motor and periodically energize the cassette motor to reduce the lower film loop to zero, as shown in FIG. 17.

Energize drum motor in the forward lead direction and energize the output rollers motor until the cut-off end of the film has passed the output rollers, as shown in FIG. 18. At this time, the output cassette motor is de-energized to avoid accidental entry of the cut off end of the film into the output cassette. It is necessary to leave a certain amount of film outside the cassette to serve as a leader for subsequent processing.

Turn off the cutter motor and remove the output cassette as indicated in FIG. 9.

New "take."

For the next composing job or "take," install an empty output cassette into the machine and repeat the sequences listed above, except that it is not necessary to hand-feed the film to the drum. Since the film on the input side has kept its correct position, energizing the input rollers motor until the film reaches the drum is sufficient. Therefore, it is not necessary to remove the covers and thus lose a certain amount of film through unwanted exposure to light.

Figure 20:
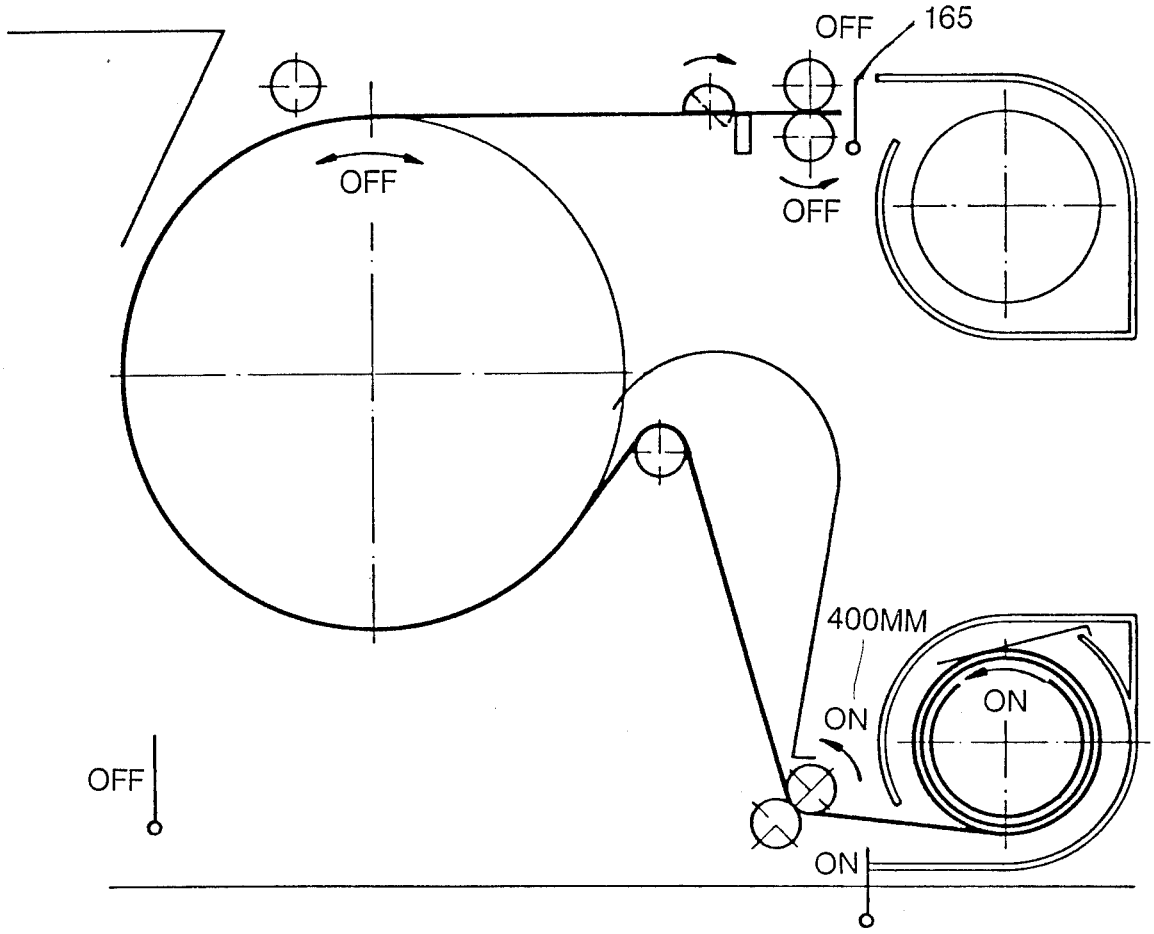

Film exhaustion (FIG. 20).

When the film contained in the input cassette 2 has been exhausted, the switch 165 is closed to cause the control unit to stop feeding information to the photo unit at an appropriate "cutoff" point. The operating switch 165 also causes the same sequence of operations as mentioned above in relation with FIGS. 17 to 19.

When a full input cassette 2 has been loaded into the machine, the loading steps described above are used to start the machine in operation again.

Figure 21:
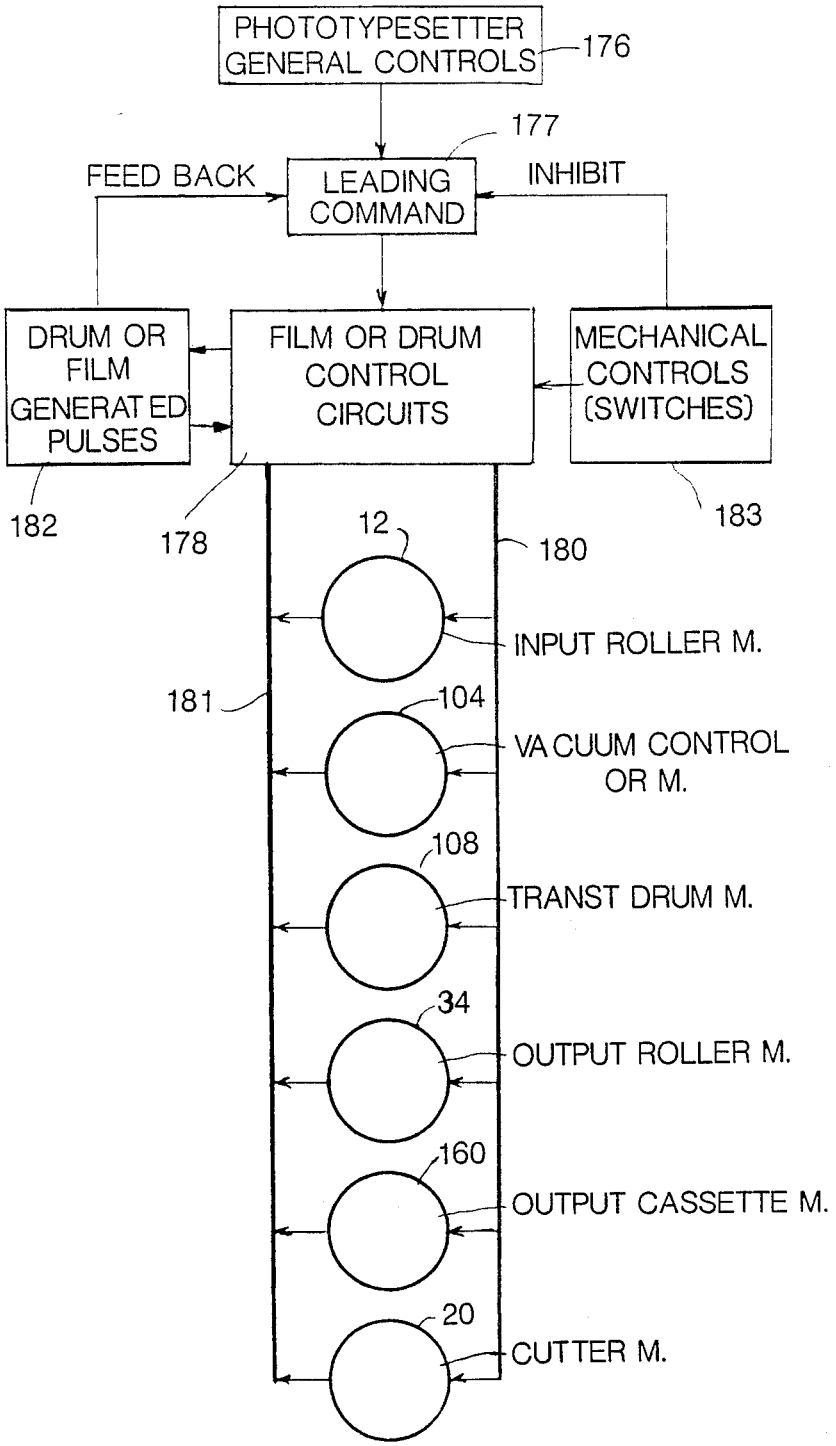
FIG. 21 is a block diagram of the electrical control circuit of the device of FIG. 1.

In the block diagram of FIG. 21 the general control circuit of the phototypesetter is shown at 176. The block 177 represents the leading command circuit, which receives all necessary information from the drum position encoder and associated circuits represented by the block 182. The block 178 represents the control circuits that generate the sequence of operations mentioned above. The control circuits preferably include a specially-programmed microprocessor or general purpose computer to instruct the sequential operation described above, in response to the signals from block 182, and the mechanical switches, which are generally represented by block 183. From block 178 emerges a control cable 180 connecting circuit 178 to the individual film handling motors as shown. Cable 181 feeds back to the general circuits the information concerning the operation of the motors.

The above description of the invention is intended to be illustrative and not limiting. Various changes or modifications in the embodiments described may occur to those skilled in the art and these can be made without departing from the spirit or scope of the invention.

We claim:

1. Photocomposing apparatus having means for forming character images on flexible photosensitive sheet material and including feed means for feeding said sheet material past an exposure station, said feed means including at least one rotary roll, guide means comprising a flange extending outwardly from the surface of said roll and having an abutment surface against which one edge of said sheet abuts to align said sheet, said roll being larger in diameter adjacent said abutment surface than at a distance from said abutment surface to give said roll a tapered surface.

2. Apparatus as in claim 1 including at least one other roll, the first-named roll and said other roll being mated together to form a drive roller assembly for moving said material.

3. Apparatus as in claim 1 in which the length of said roll is greater than the width of said material.

4. Photocomposing apparatus having means for forming character images on flexible photosensitive sheet material and including feed means for feeding said sheet material past an exposure station, said feed means including at least one rotary roll, guide means adjacent said roll and having a abutment surface against whch one edge of said sheet abuts to align said sheet, said roll being larger in diameter adjacent said abutment surface than at a distance from said abutment surface to give said roll a tapered surface, including drive means for selectively rotating said roll in opposite directions for forward and reverse leading.

5. Apparatus as in claim 4 including means for forming at least one loose loop of said material between said exposure station and an output station to provide slack to be taken up during reverse leading.

6. Photocomposing apparatus having means for forming character images on flexible photosensitive sheet material and including feed means for feeding said sheet material past an exposure station, said feed means including at least one rotary roll, guide means adjacent said roll and having an abutment surface against which one edge of said sheet abuts to align said sheet, said roll being larger in diameter adjacent said abutment surface than at a distance from said abutment surface to give said roll a tapered surface, said roll being a drum of relatively large diameter, including means for wrapping said material part-way around said drum and holding said material into the surface of said drum during projection of character images onto the material.

7. Apparatus as in claim 2 in which said guide means comprises a flange extending outwardly from the surface of said roll.

8. Photocomposing apparatus comprising a vacuum drum for transporting photosensitive sheet material past an exposure station, and for holding said material securely in place at said exposure station during exposure, said drum having a flange adjacent one end to serve as an edge guide for said material, said drum being frustroconical in shape, with a larger diameter adjacent said flange than at a distance away from said flange, input and output cassettes for said material, two feed roller devices, one between said input cassette and said drum, and the other between said output cassette and said drum, each of said feed roller devices including a pair of mating rollers at least one of which is tapered, and a guide member adjacent the largest end of said tapered roller and the nip between them to guide and align one edge of said material as it passes between said rollers, said guide members being aligned with said flange on said drum.

9. Apparatus as in claim 1 where the degree of taper of said roll is less than about one percent, and preferably is in the range of less than 0.01 to 0.1 percent.

10. Apparatus as in claim 1 in which the degree of taper of said roll is an inverse function of the diameter of said roll.

11. Photocomposing apparatus including drive means for transporting a continuous web of flexible photosensitive sheet material forwardly from an input station to an exposure station at which character images are formed, and forwardly from said exposure station toward an output station when composition is complete, said apparatus including moving means for moving said material backwardly and forwardly past said exposure station during composition, means for forming a loose loop of said material between said exposure station and at least one of said output and input stations to provide slack in said web to permit said forward and/or backward movement of said material during composition without the use of said drive means.

12. Apparatus as in claim 11 in which the movement of said material during composition is for forward and reverse leading.

13. Apparatus as in claim 11 including at least one loop storage chamber having an inlet located between said exposure station and one of said input and output stations and positioned to receive said loop as it is formed.

14. Apparatus as in claim 13 in which the capicity of said chamber is sufficient to temporarily store a loop of said material without permanently deforming it, the length of said loop being sufficient to permit the transport of at least a full page of said material during composition.

15. Apparatus as in claim 11 including a housing for said apparatus, said housing having at least one loop storage chamber for receiving and temporarily storing said loop of material, said apparatus including means for moving said material into said chamber to form said loop, and sensing means mounted within said chamber to sense said loop when it extends to a predetermined position in said chamber and to output said material.

16. Apparatus as in claim 13 including two of said storage chambers, one located between said exposure station and said output station, and the other between said exposure station and said inlet station, whereby, when said material is transported backwardly during composition, material from the loop in said one chamber is withdrawn and another loop is formed in said other chamber.

17. Apparatus as in claim 15 in which said chamber is located between said exposure station and said output station, and including another loop storage chamber located between said input station and said exposure station.

18. Apparatus as in claim 11 in which said moving means comprises a drum, drum drive means for rotating said drum in both the clockwise and counterclockwise directions, said drive means includes output feed means adjacent said output station for feeding said material forwardly, independently of said drum drive means.

19. A photocomposing method comprising the steps of:

(a) successively forming character images in lines on a web of photosensitive material;

(b) winding the resulting composition-bearing material into a roll in an output cassette while applying tension roll in an output cassette while applying tension to said material; and (c) releasing the tension on said material periodically during said winding step.

20. A method as in claim 19 in which said winding step comprises driving pinch rollers for feeding material into said output cassette, separately driving a reel in said cassette at a rate such as to pull material from said rollers faster than said rollers can feed it, thus creating said tension, and said releasing step comprising stopping the driving of said reel for a time while continuing to drive said rollers.

21. A photocomposing method comprising the steps of:

(a) moving a web of photosensitive material forwardly from an input station to an exposure station;

(b) successively forming character images in lines on said web at said exposure station;

(c) moving said material forwardly past said exposure station so as to form said material into a loose loop prior to said output station;

(d) moving the material from said loop in the reverse direction past said exposure station to form images on said material, and (e) moving the material bearing said images to said output station.

22. A method as in claim 21 including the step of forming a second loose loop in said web between said exposure and input stations during reverse movement of said web.

23. A method as in claim 21 including the step of sensing the size of said loop and outputting composition-bearing material from said loop in response to the sensing of a loop of predetermined size.

24. A method as in claim 21 including the steps of:

(f) winding the resulting composition-bearing roll in an output cassette while applying tension to said material; and (g) releasing the tension on said material periodically during said winding step.

25. A method as in claim 21 in which said moving steps comprise evacuating a vacuum drum and rotating it in the forward and reverse directions during composition; rotating pinch rollers to output said material from said output station and to input said material from said input station.

26. Photocomposing apparatus including means for forming character images on the surface of a flexible web of a photosensitve material, output means for issuing composition-bearing photosensitive material onto a reel in an output cassette, said output means comprising means for winding said material on said reel under tension, and means for periodically relieving said tension.

27. Apparatus as in claim 26 in which said output means includes reel drive means for rotating said reel, pinch-roller drive means for feeding said material into said cassette, said reel drive means being adapted to drive said reel faster than said pinch-roller driver means so as to create said tension, the periodic tension-relieving means comprising means for stopping said reel drive means while continuing said pinch-roller drive means.

* * * * *

UNITED STATES PATENT AND TRADEMARK OFFICE

CERTIFICATE OF CORRECTION

PATENT NO. : 4,553,825

DATED : November 19, 1985

INVENTOR(S) : Michel Moulin and Jean-Claude Risse

It is certified that error appears in the above-identified patent and that said Letters Patent is hereby corrected as shown below:

Claim 7, column 9, line 15, change "2" to --6--.

Signed and Sealed this

*Twenty-ninth* Day of *July 1986*

[SEAL]

*Attest:*

DONALD J. QUIGG

*Attesting Officer*

*Commissioner of Patents and Trademarks*